US006533548B1

(12) United States Patent
Wang et al.

(10) Patent No.: US 6,533,548 B1
(45) Date of Patent: Mar. 18, 2003

(54) MULTI-FUNCTIONAL ELECTRIC FAN

(75) Inventors: Peng-Chen Wang, Taipei (TW); Yu-Min Wang, Taipei (TW); Shan-Ming Wang, 3F, No. 140, Lane 91, Nei-Hu Road, Sec. 1, Taipei (TW); Te-Chuan Wang, 3F, No. 140, Lane 91, Nei-Hu Road, Sec. 1, Taipei (TW)

(73) Assignees: Li-Yen Wang Lin, Taipei (TW); Shan-Ming Wang, Taipei (TW); Pao-Chu Wang, Taipei (TW); Te-Chuan Wang, Taipei (TW)

( * ) Notice: Subject to any disclaimer, the term of this patent is extended or adjusted under 35 U.S.C. 154(b) by 294 days.

(21) Appl. No.: 09/659,696

(22) Filed: Sep. 11, 2000

(51) Int. Cl.[7] ..... F04D 29/36
(52) U.S. Cl. ..... 416/100; 416/110; 416/244 R
(58) Field of Search ..... 416/100, 110, 416/244 R, 246

(56) References Cited

U.S. PATENT DOCUMENTS 5,458,462 A * 10/1995 Shao ..... 416/100
5,720,594 A * 2/1998 Snow ..... 416/100
6,000,910 A * 12/1999 Ahn ..... 416/98

* cited by examiner

*Primary Examiner*—Ninh Nguyen
(74) *Attorney, Agent, or Firm*—Righteous Int'l Patent & Trademark Office

(57) ABSTRACT

A multi-functional electric fan comprises a U-shaped brace pivotably mounted to motor, a support for supporting the brace, an arcuate guide mechanism hinged to the support, a transmission mechanism having a plurality of gears and an arm secured to a pin through an opening of the guide mechanism, a transverse post, and a vertical post. Thus fan can pivot transversely and longitudinally by the cooperation of posts, gears, pin, and opening at the same time to reciprocally induce air movement in a transverse, longitudinal, wavy, or fixed direction.

4 Claims, 11 Drawing Sheets

MULTI-FUNCTIONAL ELECTRIC FAN

FIELD OF THE INVENTION

The present invention relates to electric fans and more particularly to a multi-functional electric fan with improved characteristics.

BACKGROUND OF THE INVENTION

Electric fans are used widely to enhance personal comfort by inducing air movement. However, the prior art electric fan suffered from several disadvantages as follows:

1. Wavy traveling path is not feasible in the electric fan having a single configuration.
2. Noisy.
3. Varied air flow rate is effected in a well known electronic controlled electric fan. However, it is prone to malfunction. Further, a transverse speed of above four cycles per second, a longitudinal speed of above six cycles per second, and wavy traveling path are not feasible in such electronic controlled electric fan. Furthermore, the manufacturing cost is high due to the installation of dual motor and other associated electronic components.

SUMMARY OF THE INVENTION

It is an object of the present invention to provide a multi-functional electric fan comprising a U-shaped brace pivotably mounted to motor, a support for supporting the brace, an arcuate guide mechanism hinged to the support, a transmission mechanism having a plurality of gears and an arm secured to a pin through an opening of the guide mechanism, a transverse post, and a vertical post. Thus fan can pivot transversely and longitudinally by the cooperation of posts, gears, pin, and opening at the same time to reciprocally induce air movement in a transverse, longitudinal, wavy, or fixed direction.

The above and other objects, features and advantages of the present invention will become apparent from the following detailed description taken with the accompanying drawings.

DETAILED DESCRIPTION OF THE PREFERRED EMBODIMENTS

Figure 1:
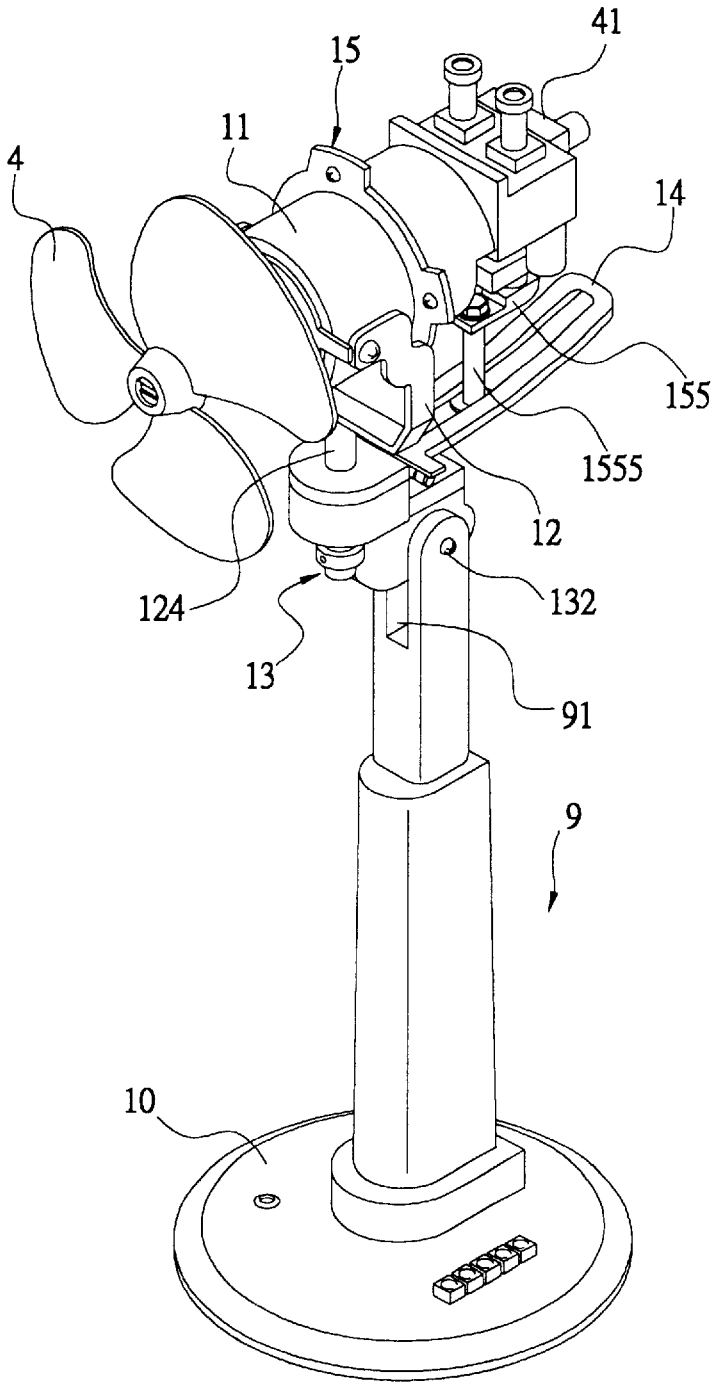
FIG. 1 is an exploded view of an electric fan according to the invention.

Referring to FIGS. 1 to 6, there is shown an electric fan 1 constructed in accordance with the first embodiment of the invention comprising a motor 11, a U-shaped brace 12 pivotably mounted to motor 11 by driving a pin 112 through a hole 111 on either side, a support 13 for supporting the brace 12, an upwardly arcuate guide mechanism 14 hinged to the support 13, a weight 41, and a transmission mechanism 15. Following is a detail description of above components.

Brace 12 comprises an upright 124 extended downwardly from the bottom center of brace 12 through a hole 131 of support 13, a collar 125 secured to the lower portion of upright 124 by a pin 126, a rearwardly extended projection 123, and a stud 122 on the end of projection 123 inserted into a hole 171 of linking member 17.

Figure 2:
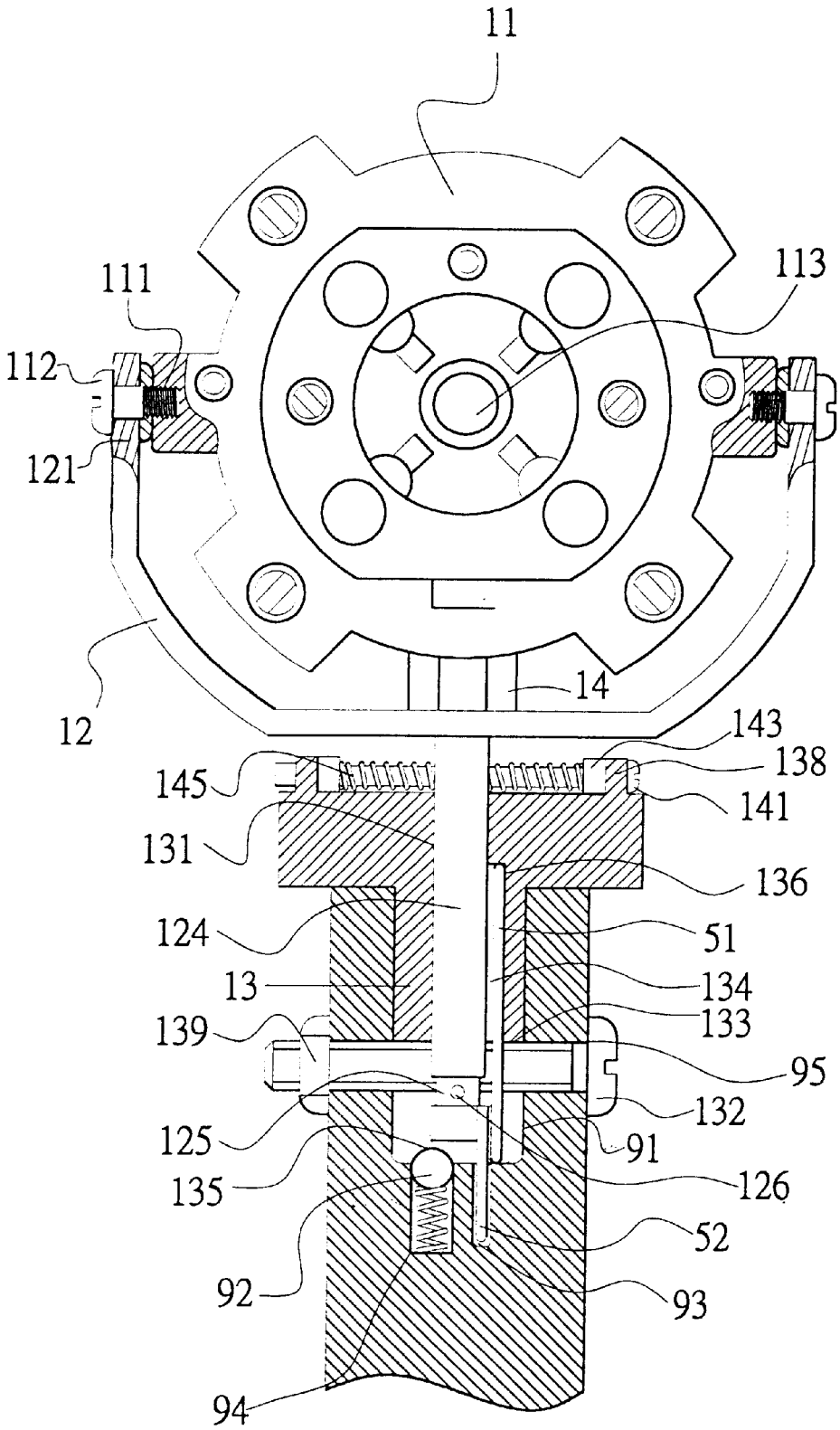
FIG. 2 is a front plan view in part section of motor, brace, and support shown in FIG. 1.
Figure 3:
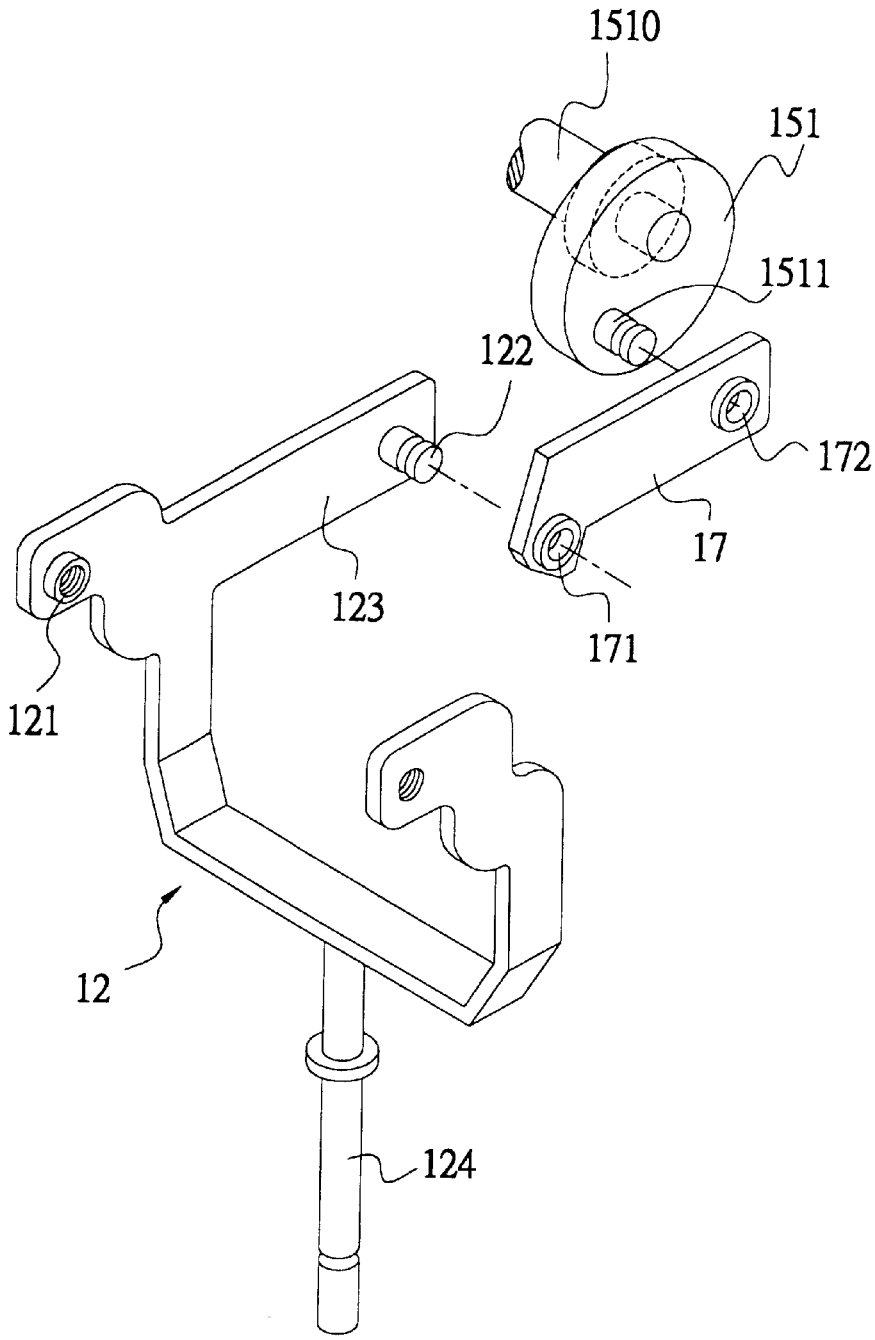
FIG. 3 is an exploded perspective view of brace, associated linking member and a part of transmission mechanism shown in FIG. 1.
Figure 5:
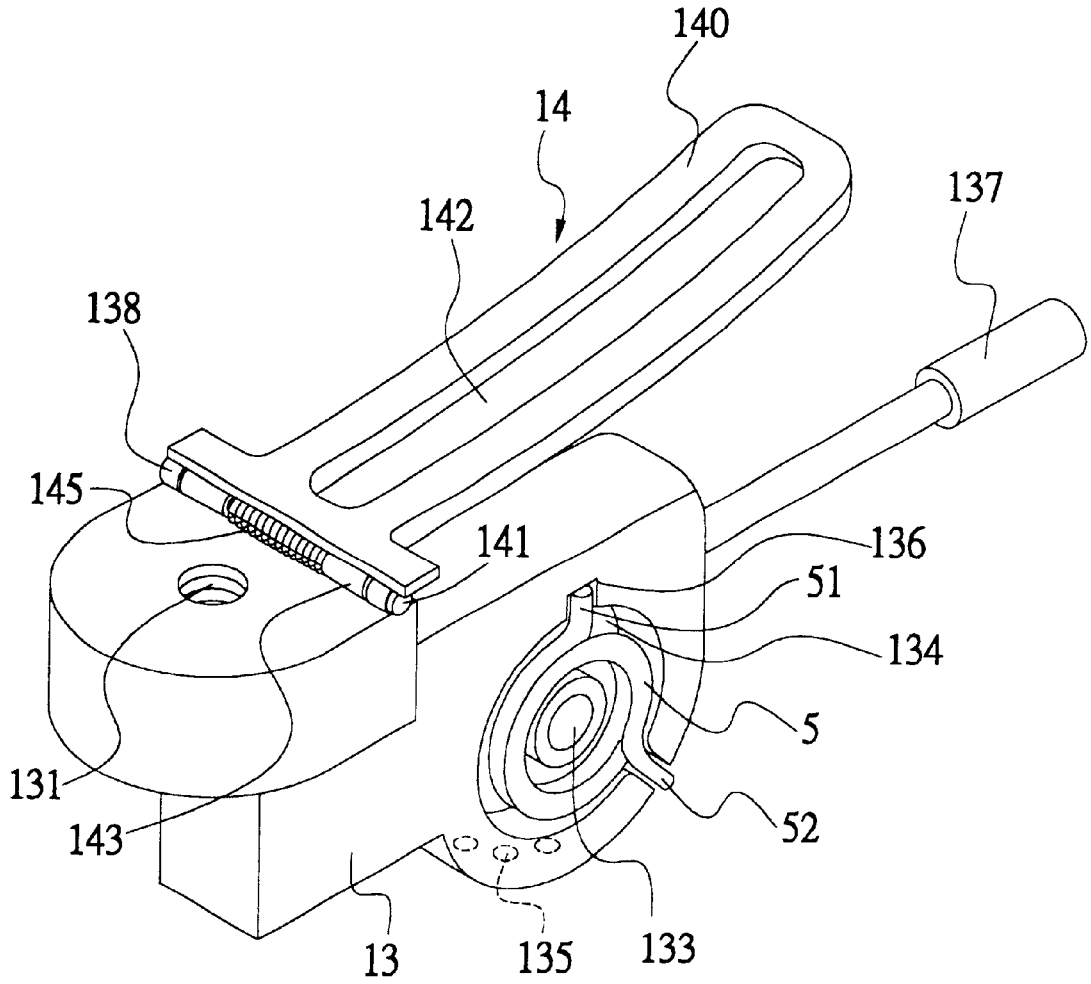
FIG. 5 is a perspective tive of the assembled guide mechanism and support shown in FIG. 1.

Referring to FIGS. 2 and 5 specifically, support 13 is secured in a recess 91 on top of an upwardly projecting upright portion 9 by securing a bolt and nut combination 132 through a transverse hole 133 and hole 95. A torsion spring 5 is anchored in a recess 134 on the outer surface of support 13. A hole 133 is provided in the center of recess 134. One end 51 of spring 5 is anchored in an aperture 136 of support 13 while the other end 52 is anchored in through hole 93 of upwardly projecting upright portion 9.

A depressible spring detent 92 is provided in a hole 94 in the bottom of recess 91 being capable of engaging with one of a plurality of indents 135 in the bottom of support 13. As such, fan may be elastically positioned by spring 5 and spring detent 92. A lever 137 is operable to adjust the angle of fan with respect to the vertical axis (i.e., upwardly projecting upright portion 9).

Figure 4:
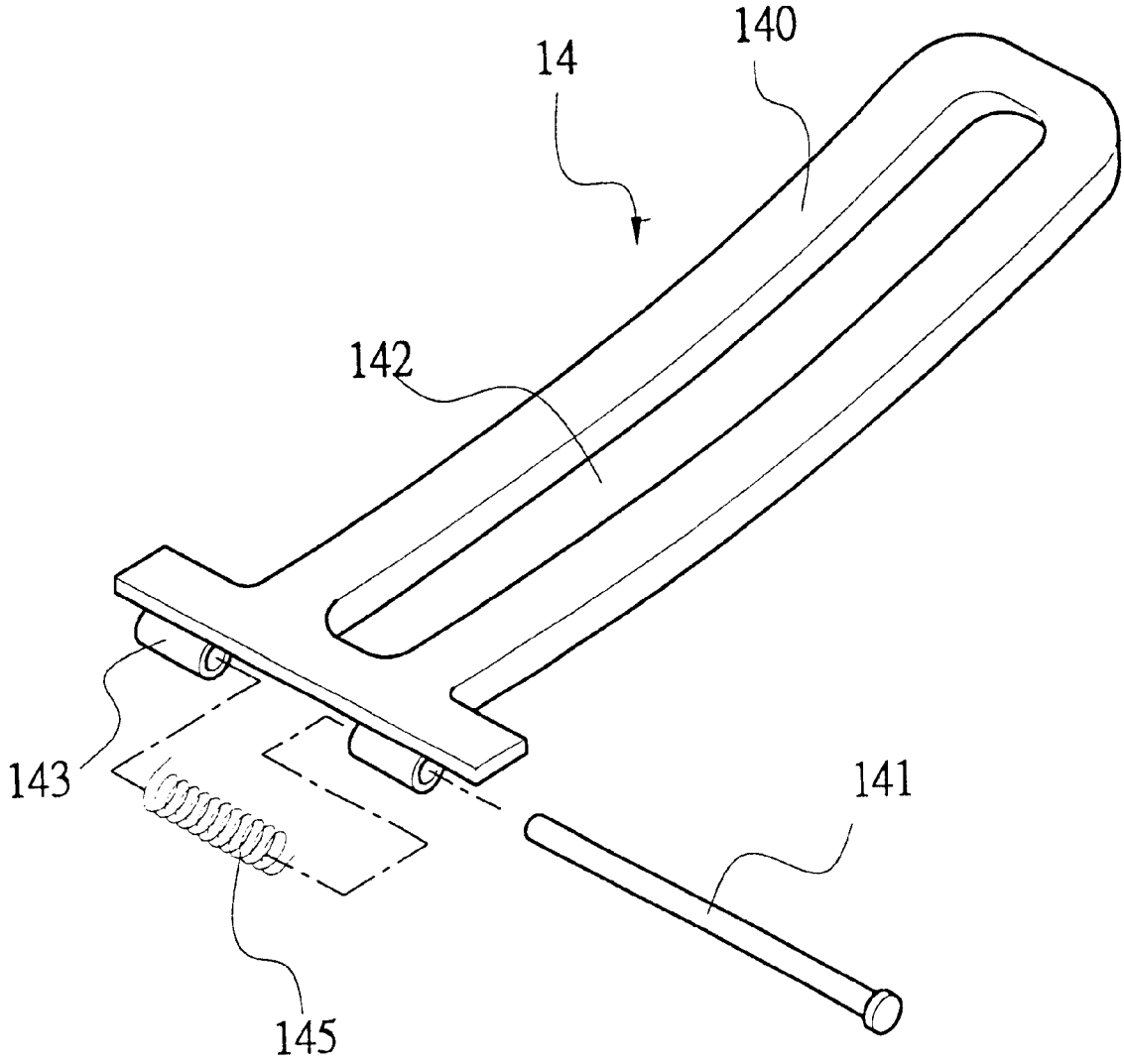
FIG. 4 is an exploded view of guide mechanism shown in FIG. 1.

Referring to FIGS. 4 and 5 specifically, guide mechanism 14 comprises an upwardly arcuate elongate plate 140 having an opening 142 and two spaced apart tubes 143 in the front side. Support 13 has two spaced apart tubes 138. A pin 141 is inserted through tube 138, tube 143, helical spring 145, the other tube 143, and the other tube 138 thus forming a hinge between support 13 and guide mechanism 14.

Figure 6:
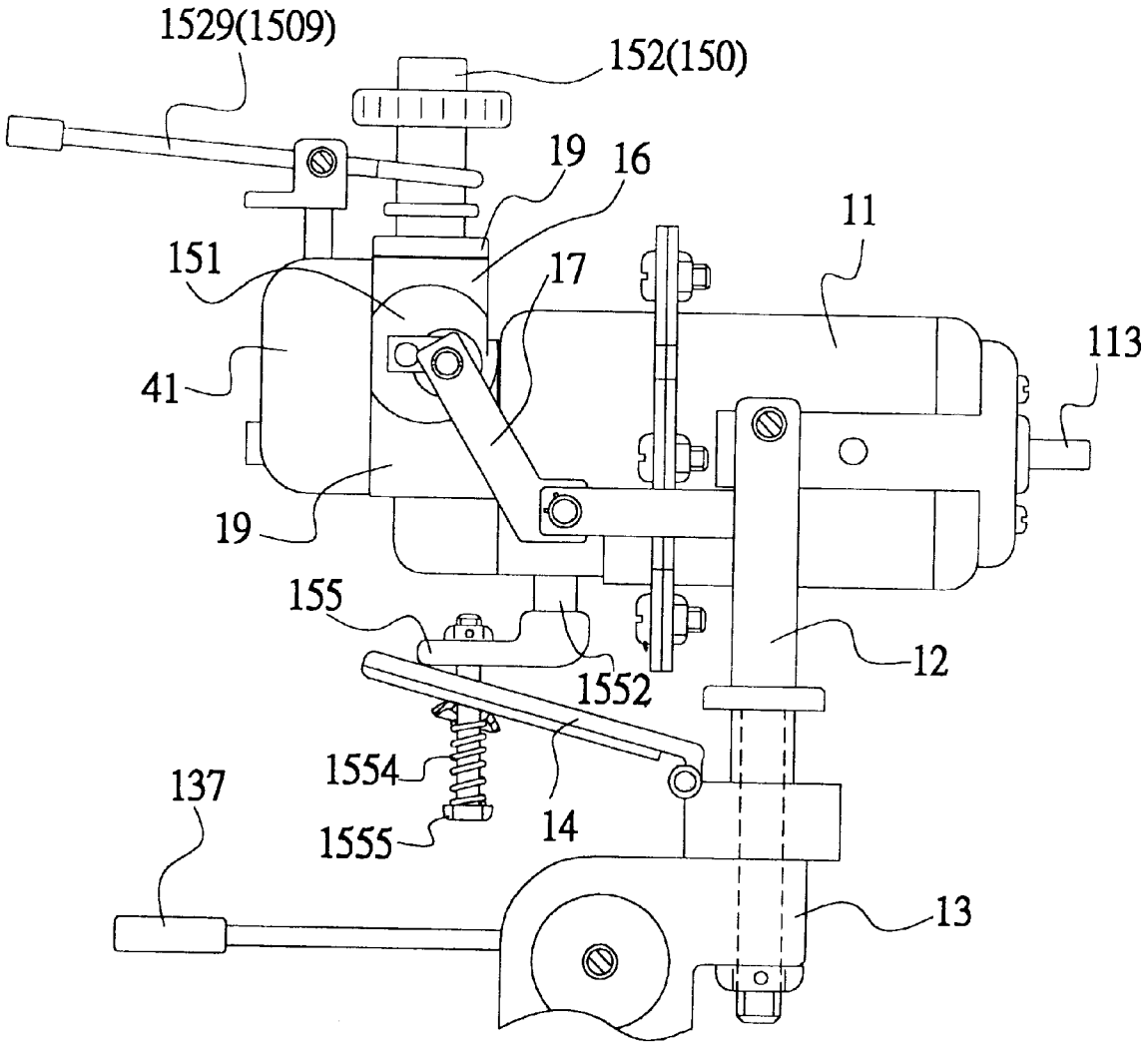
FIG. 6 is a partial side view of the FIG. 1 fan.

Referring to FIG. 6 specifically, guide mechanism 14 may be formed as a flat elongate plate. A helical spring 1554 is put on a downward pin 1555 having. an upper portion secured to an arm 155 which is in turn coupled to the bottom of transmission shaft 1552 rotatably secured to the motor 11. Pin 1555 is inserted through opening 142 so as to slide back and forth along the opening 142 when fan is rotating. Thus fan can pivot transversely and longitudinally at the same time to form a wavy traveling path while operating.

Figure 7:
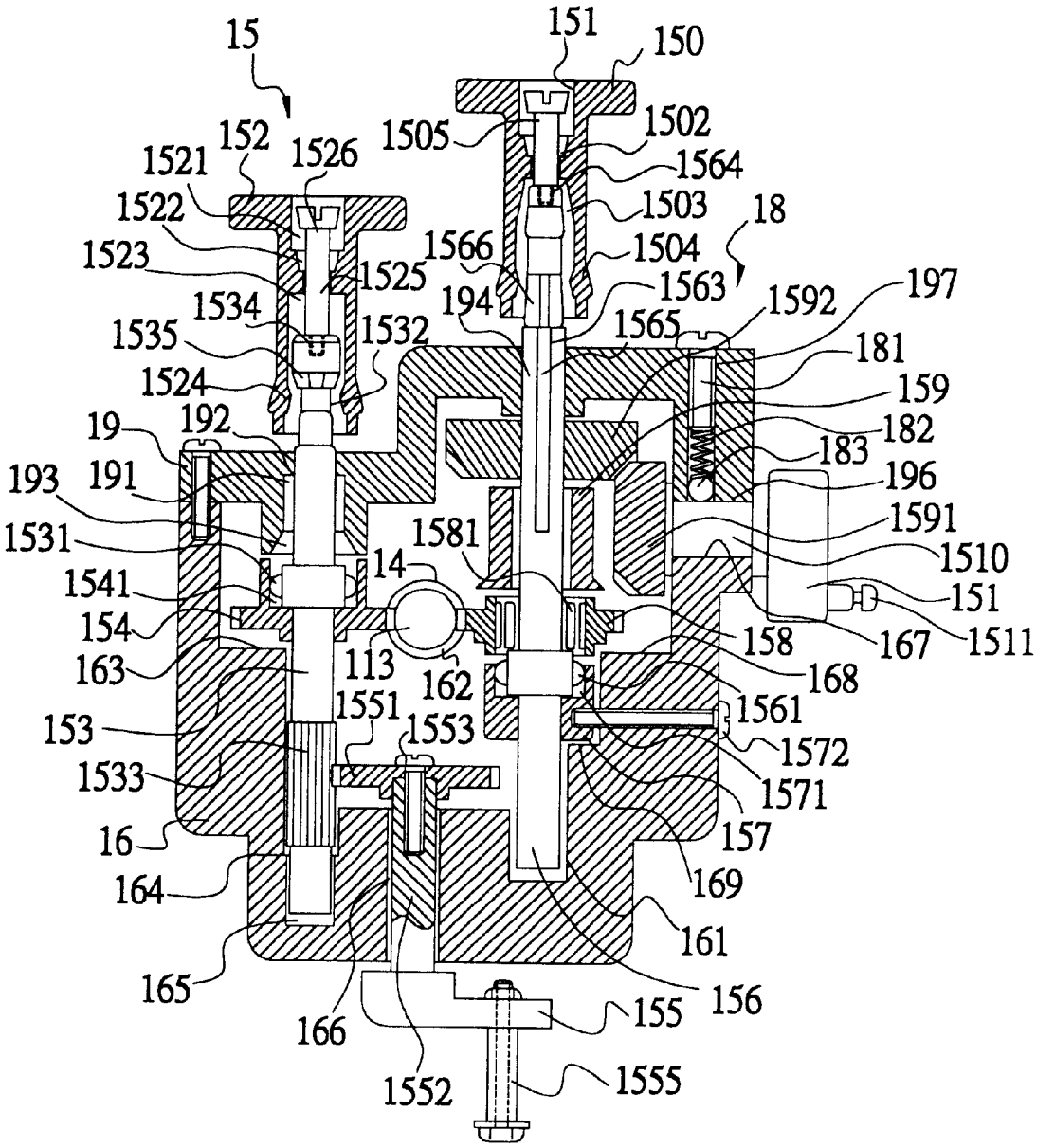
FIG. 7 is a longitudinal exploded view of a first preferred embodiment of transmission mechanism according to the invention.
Figure 8:
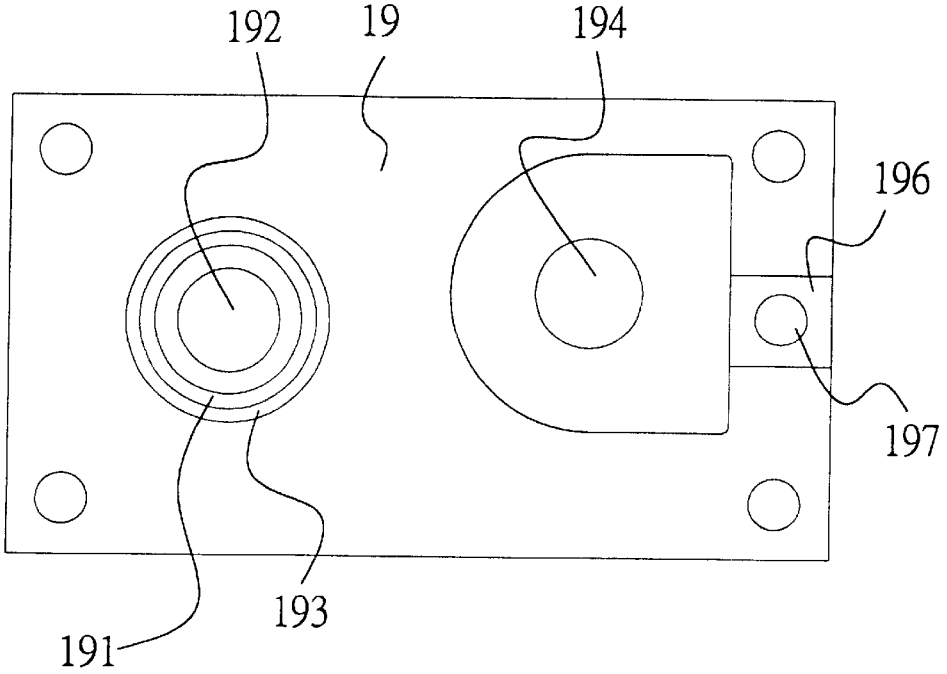
FIG. 8 is a top plan view of the cover member of the FIG. 7 transmission mechanism.
Figure 9:
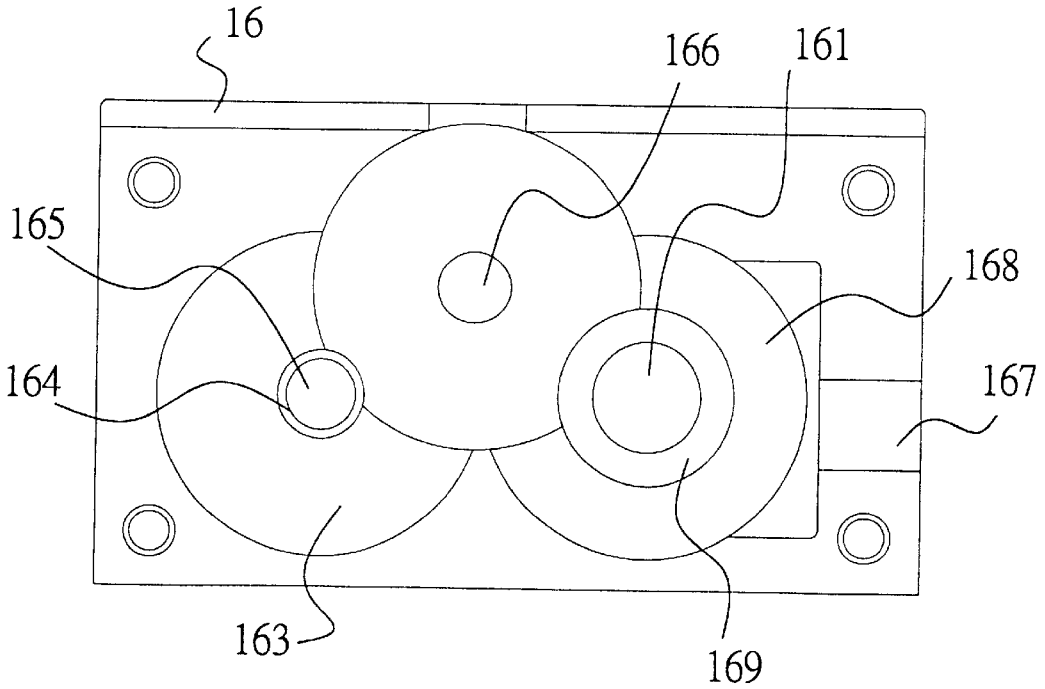
FIG. 9 is a top plan view of the gear trough of the FIG. 7 transmission mechanism.

FIGS. 7 to 9 illustrate a first preferred embodiment of transmission mechanism 15 according to the invention. Transmission mechanism 15 is provided in the rear of motor 11. The components consisting of transmission mechanism 15 are detailed below.

Lower section 16 comprises a transverse hole 162 with a drive shaft 113 of motor 11 inserted through, a first seat 163, a gear seat 164, a through hole 166, a gear 1551 on the through hole 166, a trough 167 having a half circular cross-section, a second seat 168, and a gear trough 169.

Cover member 19 comprises a left hole 192, a truncated cone 193, a recess 191 in the top of cone 193, a right hole 194, a trough 196 having a half circular cross-section mating to the trough 167, and a hole 197. A screw 181 is driven through hole 197 to compress a depressible spring detent 18 to cause the steel ball 183 to urge against shaft 1510 by the nature of helical spring 182.

A transverse hollow cylindrical member 152 is implemented as as transverse post 153 in first embodiment of transmission mechanism 15, transverse post 153 and vertical post 256 in second embodiment of transmission 25 mechanism 25, and transverse post 153 and vertical post 156 in third embodiment of transmission mechanism 35. Vertical hollow cylindrical member 150 is applicable to transmission mechanism 15 of the first embodiment.

The inside of transverse hollow cylindrical member 152 comprises a truncated cone 1522, an upper recess 1521, a lower recess 1522 having the diameter as recess 1521 two opposite protrusions 1524, and a bolt 1525 having the lower end threadedly secured to head 1534 of transverse post 153.

Transverse hollow cylindrical member 152 and vertical hollow cylindrical member 150 are threadedly secured to transverse post 153 and vertical post 156 by means of bolts 1525 and 1505 respectively. Transverse and vertical hollow cylindrical members 152, 150 can align pin 1555 with opening 142 for guiding fan in the vertical direction when engaging with transverse post 153 and guide arm 155 to slide back and forth along opening 142 when arm 155 is rotating, or adjust the transverse range of fan when engaging with vertical post 156.

A lever 1529 (or 1509) is provided in the transverse hollow cylindrical member 152 (or vertical hollow cylindrical member 150) having one end put on transverse hollow cylindrical member 152 (or vertical hollow cylindrical member 150) and a fulcrum in the shank supported on cover member 19 (see FIG. 6).

Transverse post 153 is located between recess 165 and hole 192. A downwardly tapered portion 1535 is formed on the upper part of transverse post 153. A neck 1532 is below downwardly tapered portion 1535. A gear 154 is provided in the central portion of transverse post 153 being meshed to worm gear 114 of drive shaft 113. A gear 1533 in the lower part of transverse post 153 is meshed with gear 1551 of arm 155.

Pin 1552 is inserted in through hole 166 of lower section 16. Gear 1551 is secured to pin 1552 by a screw 1553. Gear 1551 is rotated by meshing with transverse post 153.

As shown in FIG. 7, vertical post 156 is positioned between recess 161 and hole 194 of transmission mechanism 19. A truncated cone 1503 is provided in the upper part of vertical post 156. Truncated cone 1566 is provided below truncated cone 1503 by a short distance. A vertical hollow cylindrical member 150 is coupled to truncated cone 1566. A recess 1563 is coupled to second bevel gear 1592 by a key 1565 such that vertical gear 158 may rotate as vertical post 156 moves up or down. The second bevel gear 1592 is meshed with first bevel gear 1591 by passing through shaft 1510 of first bevel gear 1591 so as to actuate arm 151. A stud 1511 extended from arm 151 is coupled to hole 172 of linking member 17 such that fan may be driven to longitudinally reciprocally rotate by coupling to motor 11. A depressible spring detent 1561 is provided on vertical post 156 being inserted in gear 158.

Lower sleeve 157 is put on vertical post 156 being urged by lower shoulder 169. A screw 1572 is driven through shoulder 169 and sleeve 157 to secure them together. Upper sleeve 159 is put on vertical post 156 between the lower part of second bevel gear 1592 and upper part of gear 158.

Transverse post 153 and vertical post 156 both move up when transverse and vertical hollow cylindrical members 152, 150 move up. Then depressible spring detent 1531 clears from the rotating gear 154. Spring detent 1561 moves into recess 1581 to mesh with gear 158. As such, arm 151 is rotated by bevel gear 1592. Then brace 12 is moved longitudinally reciprocally by the linking mechanism of linking member 17. As a result, fan is also moved longitudinally reciprocally.

Transverse post 153 moves down when transverse and vertical hollow cylindrical members 152, 150 move up. Then depressible spring detent 1561 clears from the rotating gear 158. Gear 154 is driven by worm gear 114 of drive shaft 113. As such, gear 1551 and pin 1552 are activated by transverse post 153 through gear 1533. Then pin 1555 rotates eccentrically. As a result, fan is moved transversely reciprocally due to the guiding of guide mechanism 14 on pin 1555.

Transverse post 153 moves down and vertical post 156 moves up when transverse and vertical hollow cylindrical members 152, 150 move down. Then depressible spring detents 1531, 1561 move into gear 154 and gear 158 respectively to mesh therewith. As such, arms 155, 151 are rotated. Then pin 1555 is moved transversely reciprocally due to the guiding of opening 142 on pin 1555. Then brace 12 is moved longitudinally reciprocally by the linking mechanism of linking member 17. As a result, fan is moved in a wavy path due to the combination effect of transversely reciprocally and longitudinally reciprocally moving thereof.

Transverse post 153 moves up and vertical post 156 moves down when transverse hollow cylindrical member 152 moves up and vertical hollow cylindrical member 150 move down. Then depressible spring detents 1531, 1561 both clear from the rotating gear 154 and gear 158 respectively. As a result, fan is inducing air toward a fixed direction.

Figure 10:
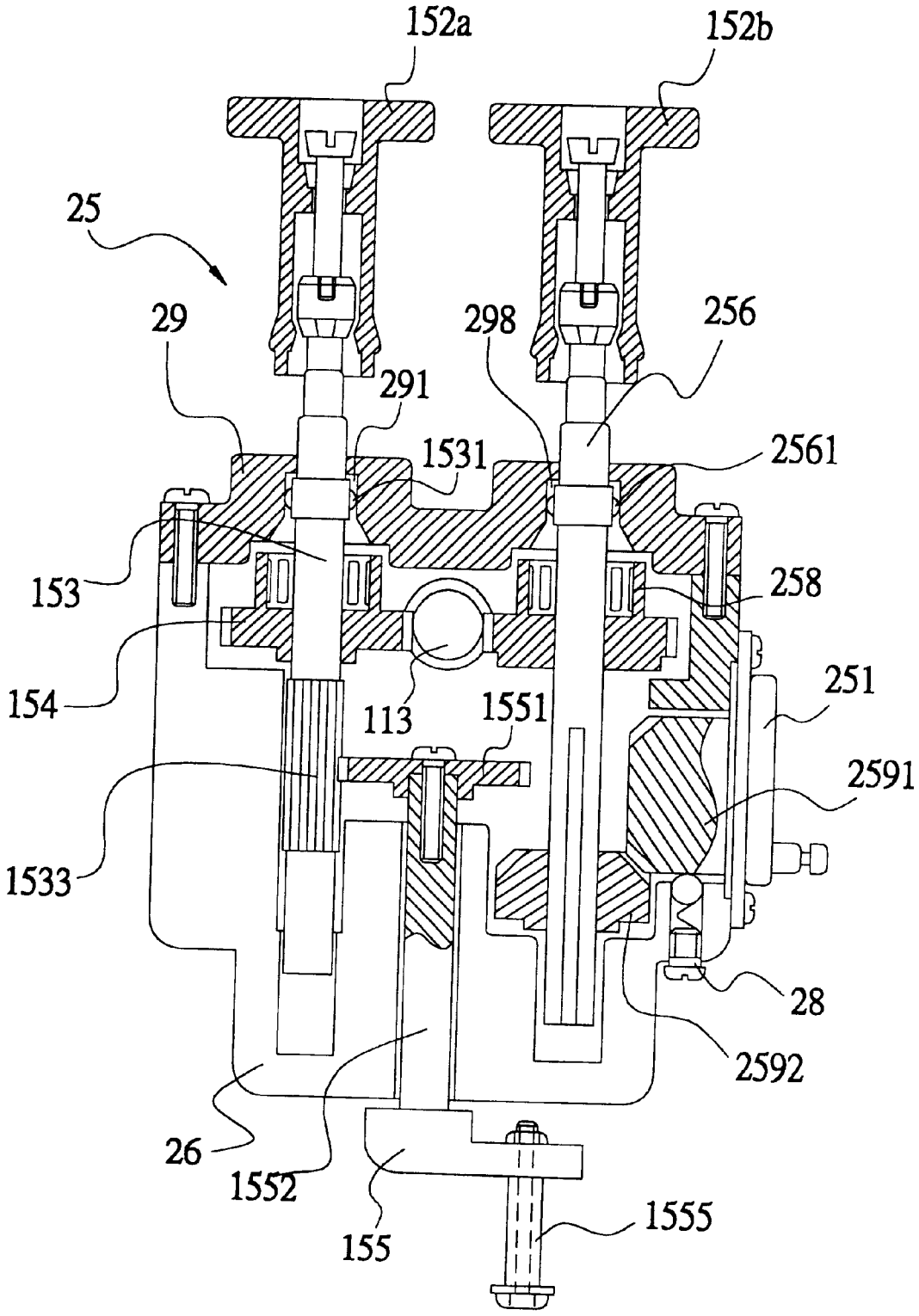
FIG. 10 is a longitudinal exploded view of a second preferred embodiment of transmission mechanism according to the invention.

FIG. 10 illustrates a second preferred embodiment of transmission mechanism 25 according to the invention comprising a lower section 16, a cover member 29, two transverse hollow cylindrical members 152*a*, 152*b*, a transverse post 153, a gear 154, an arm 155, a vertical post 256, a gear 258, an arm 251, first and second bevel gears 2591, 2592, and a depressible spring detent 28.

The configuration of this embodiment is generally the same as the first one except the following. The second bevel gear 2592 is located in the bottom of lower section 16. A pair of recesses 291, 298 (similar to recess 191) are provided on cover member 29. Cover member 29 is implemented as planar shape. Bevel gear 2592 is provided on vertical post 256 in connection with arm 251. Depressible spring detent 28 is activated to cause depressible spring detents 1531, 2561 to be flush each other.

Depressible spring detents 1531, 2561 both move into gears 256, 258 to mesh therewith respectively when transverse hollow cylindrical members 152*a*, 152*b* move down. As such, arms 155 and arm 251 are rotated. As a result, fan is moved in a wavy path due to the combination effect of transversely reciprocally and longitudinally reciprocally moving thereof.

Depressible spring detent 1531 clears from gear 154 and depressible spring detent 2561 moves into gear 258 to mesh therewith when transverse hollow cylindrical member 152*a* moves up and transverse hollow cylindrical member 152*b* move down. As such, arms 155 and 251 are rotated. Then brace 12 is moved longitudinally reciprocally by the linking mechanism of linking member 17. As a result, fan is also moved longitudinally reciprocally.

Depressible spring detent 2561 clears from gear 258 and depressible spring detent 1531 moves into gear 254 to mesh therewith when transverse hollow cylindrical member 152*a* moves down and transverse hollow cylindrical member 152*b* move up. As such, arm 255 is rotated by the activation of transverse post 153. As a result, fan is moved transversely reciprocally due to the guiding of guide mechanism 14 on arm 255.

In practice, the second transmission mechanism 25 is the most effective one.

Figure 11:
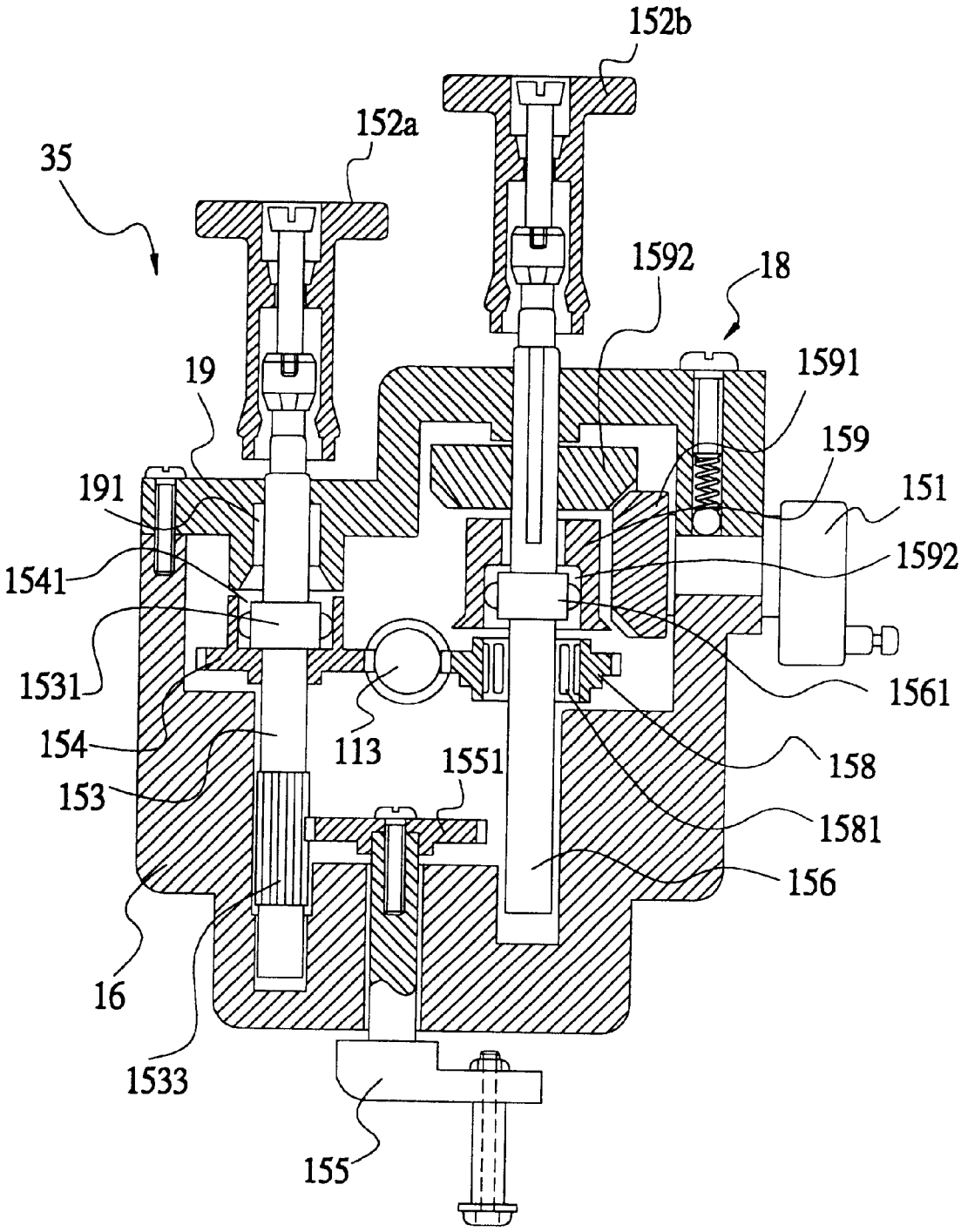
FIG. 11 is a longitudinal exploded view of a third preferred embodiment of transmission mechanism according to the invention.

FIG. 11 illustrates a third preferred embodiment of transmission mechanism 35 according to the invention comprising a lower section 16, a cover member 19, a transverse hollow cylindrical member 152*a*, a vertical hollow cylindrical member 152*b*, a transverse post 153, a pair of depressible spring detents 1531, 1561, a gear 154, an arm 155, a vertical post 156, a gear 158, an upper sleeve 159, first and second bevel gears 1591, 1592, and a depressible spring detent 18.

The configuration of this embodiment is generally the same as the first one except the lower sleeve is eliminated.

Figure 12:
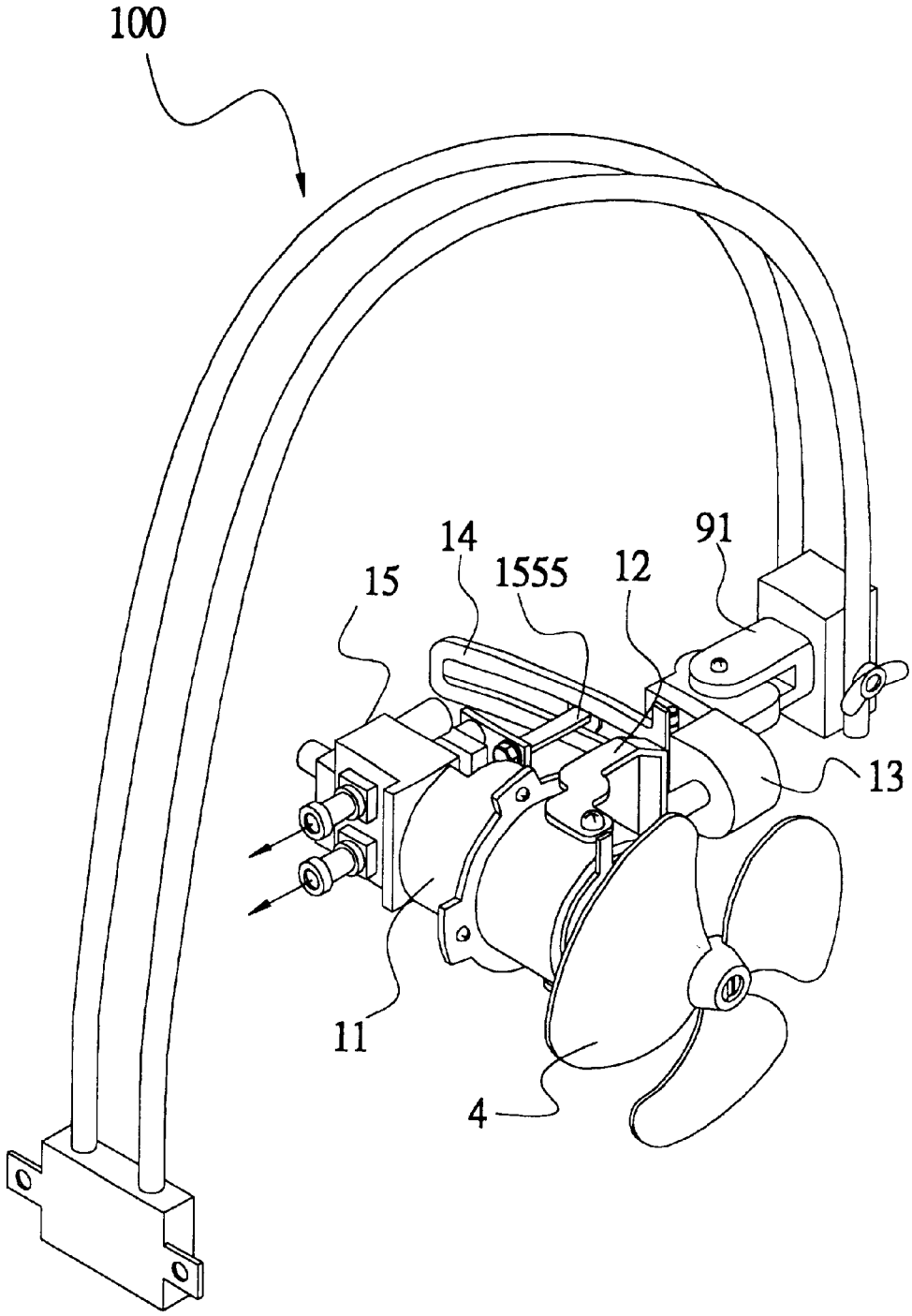
FIG. 12 is a perspective view of the electric fan of the invention mounted on a wall.

FIG. 12 is a perspective view of the electric fan of the invention mounted on a supporting arcuate member 100 attached to a wall. This fully illustrates the adaptibility of the electric fan of the invention.

While the invention herein disclosed has been described by means of specific embodiments, numerous modifications and variations could be made thereto by those skilled in the art without departing from the scope and spirit of the invention set forth in the claims.

What is claimed is:

1. An electric fan comprising:

a motor;

a U-shaped brace pivotably secured to the opposite sides of the motor, the brace including an upright extended downwardly from the bottom center of the brace, a collar secured to the lower portion of the upright by a first pin, a rearwardly extended projection, and a first stud on the end of the projection inserted into a first hole of a linking member;

a support including a second hole for receiving the upright, the support being secured in a first recess on the top of an upwardly projecting upright portion;

a torsion spring anchored in a second recess on the outer surface of the support, the torsion spring having one end anchored in a first aperture of the support and other end anchored in a first through hole of the upwardly projecting upright portion;

a guide mechanism pivotably secured to the support, the guide mechanism including an elongate plate member having an opening;

a pair of depressible spring detents operable to be engaged with one of a plurality of indents in the bottom of the support;

a first lever operable to adjust the angle of the fan with respect to the upwardly projecting upright portion;

a transmission mechanism including a downward second pin having an upper portion secured to a first arm coupled to a transmission shaft rotatably secured to the motor, the second pin being inserted into and slidable back and forth along the opening;

a lower section including a transverse hole with a drive shaft of the motor inserted through, a first seat, a gear seat, a second through hole, a first gear on the second through hole, a first trough having a half circular cross-section, a second seat, and a gear trough;

a cover member including a third hole, a second truncated cone, a third recess in the top of the truncated cone, a fourth hole, a second trough having a half circular cross-section mating to the first trough, and a fifth hole;

a transverse and a vertical hollow cylindrical members each including a second truncated cone, an upper recess, a lower recess having the diameter as the lower recess, two opposite protrusions, and a bolt having the lower end threadedly secured to the head of the transverse post;

a second lever in the transverse hollow cylindrical members having one end put on the transverse hollow cylindrical members;

a transverse post between the second recess and second hole, the transverse post including a downwardly tapered portion on the upper part of the transverse post, a second gear in the central portion meshed to a worm gear of the drive shaft, and a third gear in the lower part mesh with the gear of the first arm;

a vertical post between the second recess and the second hole, the vertical post including a third truncated cone in the upper part a first bevel gear, a fourth recess coupled to the first bevel gear, a second bevel gear meshed with the first bevel gear, a second stud coupled between the first arm and the linking member;

a lower sleeve is put on the vertical post being urged by a lower shoulder; and an upper sleeve put on the vertical post between the lower part of the second bevel gear and the upper part of the third gear, wherein the transverse and the vertical post both move up when the transverse and the vertical hollow cylindrical members move up to cause one of the detent to clear from the rotating second gear and the other detent to move into the third recess to mesh with the second gear such that the first arm is rotated by the first bevel gear, thereby emabling the brace to move longitudinally reciprocally by the cooperation of the linking member;

the transverse post moves down when the transverse and the vertical hollow cylindrical members move up to cause one of the detents to clear from the rotating second gear and the second pin rotates eccentrically, thereby enabling the brace to move transversely reciprocally; or the transverse post moves down and the vertical post moves up when the transverse and the vertical hollow cylindrical members move down to cause the detents move into the first gear and the second gear respectively to mesh therewith, thereby enabling the fan to move in a wavy path due to the combination effect of transversely reciprocally and longitudinally reciprocally moving thereof.

2. The electric fan of claim 1, further comprising a screw biased against the detent to cause the head of the detent to urge against the drive shaft.

3. The electric fan of claim 1, wherein the first lever is supported by the cover member in a position other than the ends thereof.

4. The electric fan of claim 1, wherein the guide mechanism is formed as a flat elongate plate.

* * * * *